US008613581B2

(12) United States Patent
Winkelmann et al.

(10) Patent No.: US 8,613,581 B2
(45) Date of Patent: Dec. 24, 2013

(54) DEVICE FOR MANUFACTURING PERFECT-BOUND PRODUCTS

(75) Inventors: Kai Winkelmann, Wagenfeld (DE); Jürgen Garlichs, Rahden (DE); Andreas Walther, Bünde (DE)

(73) Assignee: Kolbus GmbH & Co. KG, Rahden (DE)

( * ) Notice: Subject to any disclaimer, the term of this patent is extended or adjusted under 35 U.S.C. 154(b) by 283 days.

(21) Appl. No.: 13/066,270

(22) Filed: Apr. 12, 2011

(65) Prior Publication Data

US 2011/0255939 A1 Oct. 20, 2011

(30) Foreign Application Priority Data

Apr. 16, 2010 (DE) ..... 10 2010 015 128

(51) Int. Cl.

| | |
|---|---|
| ***B42C 11/00*** | (2006.01) |
| ***B42C 13/00*** | (2006.01) |
| ***B42C 11/02*** | (2006.01) |
| ***B42C 11/04*** | (2006.01) |
| ***B42B 9/00*** | (2006.01) |

(52) U.S. Cl.

USPC ..... 412/13; 412/11; 412/19; 412/20; 412/21; 412/4; 412/5

(58) Field of Classification Search

USPC ..... 412/4–5, 11, 13, 19–21

See application file for complete search history.

(56) References Cited

U.S. PATENT DOCUMENTS

| | | | | |
|---|---|---|---|---|
| 6,206,358 | B1 * | 3/2001 | Yamaguchi et al. | 412/11 |
| 6,352,252 | B1 * | 3/2002 | Schmucker et al. | 412/14 |
| 7,210,887 | B2 * | 5/2007 | Engert et al. | 412/20 |
| 7,621,708 | B2 * | 11/2009 | Hampel et al. | 412/11 |

(Continued)

FOREIGN PATENT DOCUMENTS

| | | |
|---|---|---|
| DE | 102 21 542 A1 | 11/2003 |
| DE | 20 2005 007 012 U1 | 9/2005 |

(Continued)

OTHER PUBLICATIONS

German Search Report 10 2010 015 128.9, dated Apr. 19, 2012, 5 pages.

*Primary Examiner* — Kyle Grabowski
(74) *Attorney, Agent, or Firm* — Alix, Yale & Ristas, LLP

(57) ABSTRACT

In a machine (1) for manufacturing perfect-bound brochures (2) that includes a book block conveying device (10) with an endless conveying means (11), a plurality of clamps (14) that are arranged on the conveying means at a fixed pitch spacing (T) and serve for clamping book blocks (3, 3.1 . . . 3.8), and of at least one processing station (25, 18, 19, 20, 21, 22, 30) that can be adjusted in a motor-driven fashion, the cycle time ($t_0$) referred to the conveyance of the clamps (14) by the pitch spacing (T) defined in the at least one processing station is divided into an adjusting segment ($t_{V1}$, $t_{V2}$) for resetting and/or adjusting the at least one processing station (25, 18, 19, 20, 21, 22, 30) in accordance with changing printed product characteristics and a processing segment ($t_{B1}$, $t_{B2}$) for processing the book blocks (3, 3.1 . . . 3.8) and/or covers (4, 4.1 . . . 4.4). The resetting of the at least one processing station to another printed product can take place within one work cycle ($t_0$) of the respective processing station while the conveyance of the book blocks (3, 3.1 . . . 3.8) continues.

14 Claims, 2 Drawing Sheets

(56) References Cited

U.S. PATENT DOCUMENTS

| | | | | |
|---|---|---|---|---|
| 7,918,635 | B2 * | 4/2011 | Richter | 412/11 |
| 8,052,135 | B2 * | 11/2011 | Katayama et al. | 412/11 |
| 2009/0155022 | A1 * | 6/2009 | Garlichs et al. | 412/21 |
| 2010/0310339 | A1 * | 12/2010 | Mueller | 412/19 |

FOREIGN PATENT DOCUMENTS

| | | | |
|---|---|---|---|
| DE | 10 2008 034 065 | A1 | 2/2010 |
| DE | 10 2008 033 184 | A1 | 3/2010 |
| WO | WO/2008/012075 | A2 | 1/2008 |

* cited by examiner

DEVICE FOR MANUFACTURING PERFECT-BOUND PRODUCTS

BACKGROUND

The invention pertains to a device for manufacturing perfect-bound printed products.

Such a device is also referred to as a perfect binder, wherein glue is applied onto the previously processed spine of the book block and a cover and/or a lining strip is placed around and pressed against the block spine. Different binding processes and product variations can be realized depending on the equipment of the perfect binder. As used herein, "book block" should be understood as encompassing several folded sections and/or sheets or the like to be perfectly bound into printed products such as brochures, magazines or book blocks for hard covers.

DE 20 2005 007 012 U1 describes a binding machine of this type with a book block conveying device consisting of an endless conveying means that revolves around deflection pulleys and a plurality of clamps for clamping sheet stacks that are respectively arranged on the conveying means at the same pitch spacing from one another. Various processing stations (such as a book block infeed station, spine processing station(s), glue application station(s), cover feeder, pressing station(s) and delivery station) are provided along straight conveying sections in order to carry out the required processing steps in accordance with the respective binding process. In perfect binders of the medium and high performance range, the clamps are arranged on the conveying means in very close succession with a minimum practical pitch spacing that is slightly larger than the length of the clamp, i.e., minimum (theoretical) pitch spacing that can be accommodated by the book block conveyor. In the processing stations, a cycle time referred to the pitch spacing is defined, wherein one complete work cycle is respectively carried out within this cycle time simultaneously with the conveyance of the clamps that are advanced by the pitch spacing.

Such perfect binders with a plurality of continuously revolving clamps serve for the mass production of identical brochures or book blocks with high manufacturing efficiency. The perfect binders are set up for a certain printed product and subsequently produce the desired edition in a single pass. During the production, the adjustments of the various processing stations are corrected, if so required, in order to improve the quality of the printed product.

After the last printed product of a print run has exited the perfect binder, the machine is reset to the next printed product. Control variables related to the formats (height, width, thickness) of the input products and end products, as well as generally format-independent control variables, are changed in the processing stations of the perfect binder while the book block conveying device is at a standstill. The guides and conveying means in the feed devices for the input products also need to be reset to the new dimensions of the book blocks and covers. Format-independent adjustments, e.g., may consist of the depth and the spacing between the notches to be produced in the book block spine in a spine processing station or of the respective glue application thickness in gluing stations.

Although the essential resetting processes in these perfect binders have meanwhile been automated by means of a central control device and motor-driven adjusting axle systems and these resetting processes essentially take place in parallel, each production change is still associated with a time-consuming set-up process that is economically disproportionate to the actual processing time, particularly with respect to smaller print runs.

SUMMARY

It is therefore the objective of the present invention to develop a device for manufacturing perfect-bound printed products which allows a continuous manufacture of printed products that differ, in particular, with respect to their format dimensions.

This objective is attained in that the cycle time of the processing stations is divided into an adjusting segment for resetting and/or adjusting the at least one processing station in accordance with changing printed product characteristics and a processing segment for processing the book blocks and/or covers.

The resetting of the processing stations to another printed product can take place within one work cycle of the respective processing station while the conveyance of the book blocks continues. The processing stations can be adjusted after each book block conveyed past the respective processing station such that it is possible to react to individual product fluctuations within a print run and to continuously manufacture different printed products in a batch size of one. Consequently, book blocks of several different printed products may be situated in the book block conveying device.

The perfect binder no longer needs to be stopped in order to be reset to another printed product such that the set-up time is practically eliminated. Until now, this set-up time was composed at least of the time segments required for emptying the perfect binder, for stopping the book block conveying device, for adjusting the processing stations in parallel, wherein this time segment is defined in the processing station with the longest resetting time, and for starting up the book block conveying device. The productivity of the perfect binder is significantly increased, particularly for smaller print runs, because the book block conveying device can be continuously operated with a high conveying speed. The energy efficiency is also improved because the book block conveying device does not have to be decelerated and accelerated for a product change and empty clamps are reduced to a minimum. Perfect binders of this type with the inventive processing stations can be used for manufacturing printed products in high-volume print runs, as well as for the individual production of, for example, digitally printed contents and allow an economical production in both instances.

A corresponding adjusting segment within the cycle time of the processing stations can be easily realized by initially setting up the machine with an increased pitch spacing relative to the minimum practicable spacing with the clamps continuously conveyed at a constant conveying speed. The adjusting segment can thereby be realized at least as long as the processing segment with a pitch spacing that is at least twice as long as the length of the clamps. The preferred pitch spacing is equal to three times the minimum theoretical pitch spacing referred to the clamp length. Due to this measure, an adjusting time that makes it possible to reset the processing stations to a more significant format change of the printed product such as, e.g., a change of the block thickness by several millimeters is also available at a high conveying speed of the clamps. A corresponding adjusting segment within the cycle time of the processing stations can also be realized in that the cycle time selectively extends over one, two or more clamps, wherein the clamps that are assigned to the cycle time and situated upstream of the clamp holding the book block to be processed do not contain book blocks. The book block infeed station preferably features a timing device for releasing and feeding the book blocks from a book block cue to the corresponding clamp of the respectively selected cycle time.

According to an additional development, a flexible division of the cycle time is achieved if the ratio between the adjusting segment and the processing segment is variable. Depending on whether the respective processing requires a longer or shorter period of time due to the format, material and/or design of the printed product, the potentially saved processing time can be added to the adjusting segment and vice versa. In combination with a cycle time that selectively extends over one, two or more clamps, this makes it possible to flexibly adapt the adjusting segment to the respective adjusting task.

The at least one processing station preferably features at least one working appliance that can be acted upon with a motion profile that is variable within the cycle time by means of a driving device with at least one individual drive. In this way, the respective processing steps to be carried out on the book block or the cover can be very easily shortened or extended referred to the cycle time.

A maximum format change that can be realized within the cycle time during the adjusting segment such as, for example, a maximum change of the product thickness by +/−6 mm can be derived from a given conveying speed of the book block conveying device. On the other hand, the adjusting time required for a certain format change makes it possible to derive a maximum conveying speed of the book block conveying device that can be achieved with a cycle time extending over one clamp or, if applicable, over several clamps.

At least one measuring device for measuring at least one characteristic is arranged upstream of the at least one processing device, in particular, for the adjustment of processing stations that are adjusted in dependence on the work result of preceding processing stations in order to achieve an optimal work result.

A control device that is connected to a drive system of the book block conveying device makes it possible to reset the processing stations to another printed product successively with the continuous conveyance of the respective book blocks during a production run. An identification device for book blocks fed to the perfect binder is preferably assigned to the control device. Data required for resetting the processing stations can be retrieved from a memory connected to the control device or derived from the identification data. Analogous to the successive resetting, the book block infeed station is divided into several successive conveying segments for feeding the book blocks to the clamps, wherein the individual conveying segments can be adjusted separately in accordance with the block thickness of the respective book block that subsequently arrives at the respective conveying segment.

BRIEF DESCRIPTION OF THE DRAWING

Characteristics of the present invention are elucidated in the following description of one preferred embodiment that refers to the accompanying drawing, in which.

DETAILED DESCRIPTION

Figure 1:
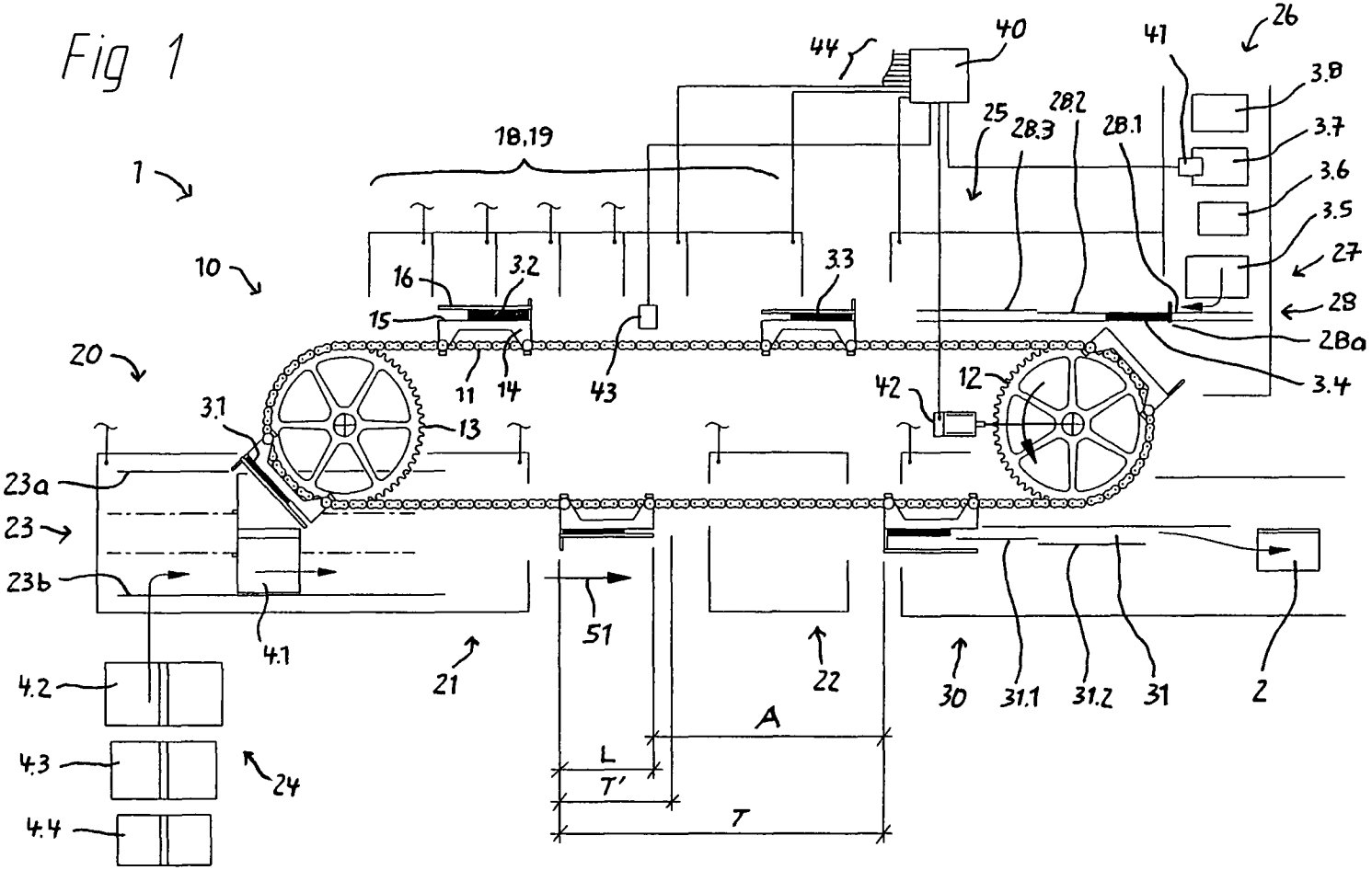
FIG. 1 shows a partially schematic top view of a perfect binder.

The perfect binder 1 illustrated in FIG. 1 includes a book block conveying device 10 with an endless conveyor chain 11 that continuously revolves around a driven chain wheel 12 and a deflection chain wheel 13 in an oval fashion and serves as a conveying means with a plurality of clamps 14 that are arranged on the conveyor chain loop 11 such that they are spaced apart from one another. Processing stations are arranged along straight conveying sections and can be adjusted in a motor-driven fashion such as a book block infeed station 25, spine processing stations 18, glue application stations 19, a cover feeder 20, pressing stations 21, 22 and a delivery station 30. The clamps 14 respectively feature a stationary inner clamping jaw 15 and an outer clamping jaw 16 that can be moved relative to the inner clamping jaw in order to clamp book blocks 3.1 . . . 3.8 that are composed of several folded sections and/or sheets, wherein the block spine downwardly protrudes from the clamp 14.

The perfect binder 1 makes it possible to manufacture perfect-bound brochures 2 or book blocks for hardcovers, wherein glue is applied onto the previously processed block spine and a cover 4.1 . . . 4.4 and/or a lining strip is placed around and pressed against the block spine. Different binding processes and product variations can be realized depending on the equipment of the perfect binder.

According to the present disclosure, the perfect binder 1 is designed such that it can be reset to another printed product during a production run while the conveyance of book blocks 3.1 . . . 3.8 in the book block conveying device 10 continues. For this purpose, the cycle time $t_0$ of the respective processing stations is divided into an adjusting segment $t_{V1}$, $t_{V2}$ for resetting and/or adjusting the processing station in accordance with changing printed product characteristics and a processing segment $t_{B1}$, $t_{B2}$ for processing the book blocks and/or covers. The perfect binder 1 does not have to be stopped in order to be reset. The resetting takes place successively, i.e., the processing stations 25, 18, 19, 20, 21, 22, 30 are reset in succession according to their arrangement along the book block conveying device 10 and its conveying speed. The resetting may also concern the book block conveying device 10 with the clamps 14, the opening and closing width of which may have to be adjusted to the block thickness. Clamps 14 that automatically adjust to the block thickness do not require resetting.

The resetting process initially requires a generally known identification of the book blocks 3.1 . . . 3.8 in the region of a book block feed 26 and a corresponding assignment of the covers 4.1 . . . 4.4 to the book blocks 3.1 . . . 3.8, i.e., the covers 4.1 . . . 4.4 need to be fed to the perfect binder 1 by a cover feed 24 in the same sequence as the book blocks 3.1 . . . 3.8. In FIG. 1, for example, a sensor 41 connected to the control 40 scans a code applied onto the book blocks 3.1 . . . 3.8. The required product data is either directly derived from the code or the code contains a data set that is stored in the control 40 or can be retrieved from a memory.

It is also possible to use one or more sensors that measure the respective product dimensions directly on the book block 3.1 . . . 3.8, e.g. in the form of a block thickness measurement. The measurement can be carried out on the passing book blocks 3.1 . . . 3.8 or the book blocks 3.1 . . . 3.8 can be manually guided into a corresponding measuring device in the sequence, in which they are fed into the perfect binder 1.

The resetting of the processing stations 25, 18, 19, 20, 21, 22, 30 comprises format-dependent and format-independent control variables that define corresponding active elements in the processing stations with respect to their position in time and/or space by means of different types of actuators (motor-driven adjusting axles, pneumatically driven cylinders, etc.) or electronic adjustment of servo drives. Examples of such active elements are the guide elements 28.1 . . . 28.3, 23.1, 23.2, 31.1, 31.2 in the conveying paths 28, 23, 31 of the book block and cover feeds.

Figure 3:
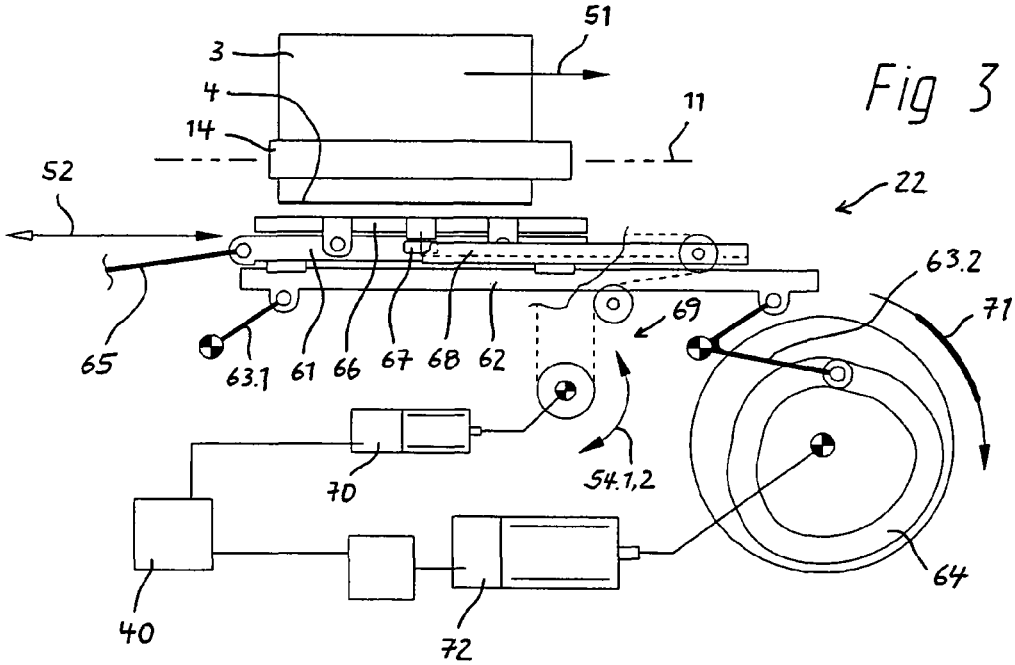
FIG. 3 shows a partially schematic side view of the pressing station.

The resetting within a cycle time $t_0$ is explained in an exemplary fashion with reference to the pressing station 22 that is illustrated in greater detail in FIG. 3 and in which the cover 4 attached to the spine of the book block 3 is once again firmly pressed on. For this purpose, a contact table 61 is provided that can be moved up and down, as well as forward and backward in the direction of the clamp motion 51, and lateral pressing bars 66 are mounted on the contact table 61 in a transversely displaceable fashion. The contact table 61 is displaceably guided on a support 62 arranged on parallel guide rods 63.1, 63.2, wherein one guide rod 63.2 is controlled by a rotationally driven cam plate 64 in order to move the contact table 61 up and down in accordance with the processing sequence. The fixed cyclic forward and backward motion 52 of the contact table 61 is realized with the aid of a coupler 65 of a not-shown mechanical drive unit.

The pressing station 22 needs to be reset with respect to the lateral pressing bars 66 to be adjusted to the respective block thickness. These lateral pressing bars are guided in radial cams 68 by means of cam rollers 67 such that the pressing bars 66 are closed and opened in accordance with the block thickness during the cyclic forward and backward motion 52 of the contact table 61. The radial cams 68 are positioned transverse to the clamp motion 51 by an adjusting drive 69 with assigned adjusting motor 70.

Figure 2A:
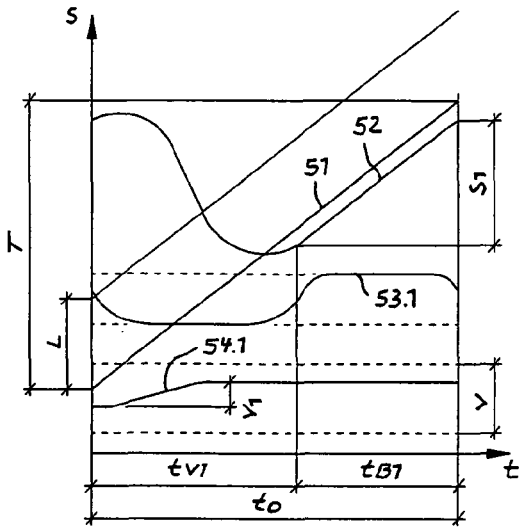
FIGS. 2 *a, b* show motion diagrams of a pressing station of the perfect binder.
Figure 2B:
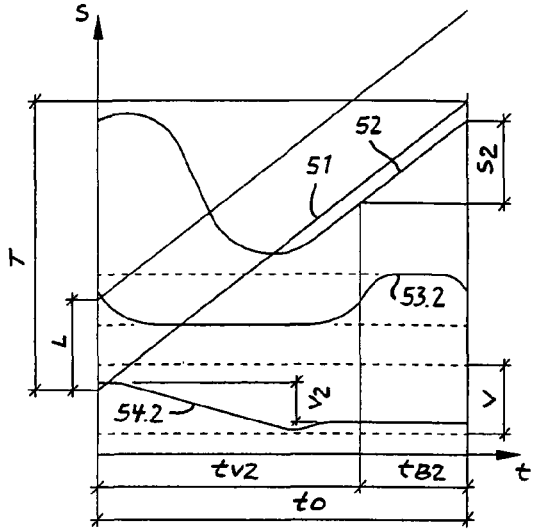

FIG. 2 *a* and FIG. 2 *b* show motion diagrams for different adjusting processes during a respective work cycle $t_0$. During the cycle time $t_0$, a clamp 14 moves from the length L by a distance that is equal to the pitch spacing T. The clamp motion 51 is drawn in the form of a straight line and therefore corresponds to a constant conveying speed. The forward/backward motion 52 of the contact table 61 takes place synchronous with the clamp over a section thereof. The lifting motion 53.1 or 53.2 of the contact table 61 can be varied by means of the cam plate 64 that can be driven with a variable rotational speed 71 by a servomotor 72 such that the actual pressing phase of the contact table 61 against the book block spine can be shortened or extended. The respective processing segment $t_{B1}$ and $t_{B2}$ is derived from the respective lifting motion 53.1 and 53.2. The respective complementary adjusting segment $t_{V1}$, and $t_{V2}$ is extended or shortened accordingly.

FIG. 2 *a* shows an adjusting motion 54.1, during which the control bars 68 are adjusted from a larger block thickness to a smaller block thickness by a relatively short adjusting path $v_1$ within a correspondingly short adjusting time such that the adjusting segment $t_{V1}$ is limited to a minimum and the processing segment $t_{B1}$ with the processing section $s_1$ can utilize the maximum phase of synchronism between the contact table 61 and the clamp 14.

FIG. 2 *b* shows an adjusting motion 54.2, during which the control bars 68 are adjusted from a smaller block thickness to a larger block thickness by an adjusting path $v_2$ that corresponds to nearly the entire adjusting path v. The required adjusting time is achieved with an extended adjusting segment $t_{V2}$ that was realized by correspondingly shortening the processing segment $t_{B1}$ and therefore a reduced processing section $s_2$. The interaction between the adjusting motion 54.1 or 54.2 and the variable lifting motion 53.1, 53.2 is realized with a master control 40 that also coordinates the resetting of the other processing stations 25, 18, 19, 20, 21, 22, 30.

For this purpose, the control 40 is connected to the processing stations via control lines 44 and knows the current adjustments thereof. In addition, the required adjustments of the processing stations for processing the respectively identified book blocks 3.1 . . . 3.8 and the corresponding covers 4.1 . . . 4.4 can be defined based on product data and are stored or, if applicable, can be calculated in the control 40.

The control 40 determines the respective resetting times in the processing stations 25, 18, 19, 20, 21, 22, 30 before the transfer of the book blocks 3.1 . . . 3.8 to the clamps 14. These resetting times are dependent on the adjusting motions and the adjusting speeds for the respective control variables stored in the control 40. In adjusting axles with threaded spindles, the adjusting direction is also taken into account as shown in FIG. 2 *b*. The target position is always reached from a farther adjusting position in order to eliminate the play between spindle and nut.

The maximum required resetting time of a processing station is used by the control 40 and converted into a conveyor spacing that is rounded up in accordance with the clamp arrangement and defines the distance, by which the first book block of the subsequent printed product follows the last book block of the preceding printed product.

A respective processing station is reset while the gap created due to the conveyor spacing moves past the corresponding processing station. The resetting begins as soon as the book block of the preceding printed product or the corresponding clamp 14 exits the respective processing station. For this purpose, the control 40 is connected to the drive system 42 of the book block conveying device 10 and features a product tracking system for each individual book block that is identified in the book block feed 26 and conveyed on the book block conveying device 10. The processing stations are practically reset in advance of the respective first book block of the subsequent printed product.

The book block infeed station 25 comprises a block feeder 27 in the form of a timing device, by means of which this first book block can be transferred into a block conveying channel 28 after the conveyor spacing in order to be fed to a clamp 14 by a pusher 28 *a*. A buffer for intermediately storing subsequent book blocks may be assigned to the block feeder 27.

The block conveying channel 28 is divided into successive conveying segments by guide elements 28.1 . . . 28.3 that can be individually adjusted to the block thickness. As soon as the last book block of the preceding printed product exits such a conveying segment, the respective guide element 28.1 . . . 28.3 is adjusted to the next block thickness. In FIG. 1, a book block 3.3 of average thickness was conveyed in the front conveying segment that is defined by the guide element 28.3. A subsequent thinner book block 3.4 is situated at the transition from the first to the second conveying segment. Consequently, both guide elements 28.1 and 28.2 are adjusted to the same thickness. Similar to the book block infeed station 25, a conveying channel 31 in the delivery station 30 is also divided into successive conveying segments by means of corresponding guide elements 31.1, 31.2 that can be individually adjusted to the brochure thickness.

As mentioned above, the sensor 41 may consist of a measuring device for measuring or determining at least the block thickness of a book block that is subsequently transported by means of the book block infeed station 25 and the book block conveying device 10. The thusly determined book block thickness makes it possible to define most control variables for the various processing stations including the book block conveying device 10 with sufficient accuracy.

For very accurate processing steps such as scoring, attaching and pressing on the covers 4.1 . . . 4.4, the adjustment of the corresponding processing stations 20, 21, 22 is carried out based on the block thickness of the book block clamped into the clamp 14. This makes it possible to detect, in particular, block thickness fluctuations of generally identical book blocks 3. For this purpose, the block thickness is measured with a second sensor 43 that is arranged downstream of a spine processing station 18 if joint edges that may be present in the spine and distort the actual block thickness are cut off. Sensors may also be arranged at other locations of the book block conveying device 10 in order to determine product characteristics, according to which downstream processing stations can be adjusted.

It can thus be appreciated that the cycle time ($t_0$) is divided into an adjusting time segment ($t_{V1}$, $t_{V2}$) for resetting and/or adjusting at least one processing station (25, 18, 19, 20, 21, 22, 30) in accordance with changing printed product characteristics and a processing time segment ($t_{B1}$, $t_{B2}$) for processing the book blocks (3, 3.1 . . . 3.8) and/or covers (4, 4.1 . . . 4.4). The term "resetting" should be understood as encompassing adjustment, e.g., alteration of process step and/or adjustment in the position of a component of the processing station, and the phrase "processing of book blocks" should be understood as including any process that is associated with the binding machine, including the processing of covers for the book blocks.

In the perfect binder 1, all clamps 14 are preferably arranged on the conveyor chain 11 such that they are spaced apart from one another by an increased pitch spacing T, wherein the increased pitch spacing T approximately corresponds to three times the minimum theoretical pitch spacing T referred to the clamp length L such that a corresponding fixed conveyor spacing A is provided after each clamp 14 in the book block conveying device 10.

The processing stations can be adjusted after each book block that is guided past the respective processing station and therefore allow the continuous manufacture of different printed products, particularly with a respective print run of one. The fixed conveyor spacing A makes it possible to reset the printed products within a limited format change between successive printed products, e.g. a change in the format thickness of up to +/−6 mm.

For a more significant format change with respect to the resetting time, one or more successive clamps 14 are not occupied in order to create an increased conveyor spacing. The number of thusly unoccupied clamps 14 can be reduced by feeding the printed products to the perfect binder 1 in such a sequence that respectively successive printed products of a different format differ from one another by no more than the limited format change.

Although the perfect binder 1 is optimized for the manufacture of printed products with a respective print run of one due to the increased pitch spacing T, it is also possible to economically manufacture larger batches with the perfect binder 1. Due to the increased pitch spacing T, two thirds of the clamps 14 that are usually provided in such a perfect binder are eliminated in the exemplary embodiment. This not only significantly reduces the costs of the book block conveying device, but also its overall moving mass.

Alternatively, it would be possible to provide a pitch spacing between the clamps 14 that is increased in comparison with the pitch spacing T' between the remaining clamps 14 at only a few locations of the conveyor chain 11 of the perfect binder such that a corresponding fixed conveyor spacing is provided in the book block conveying device 10 at these locations. During a product change, the first book block of the subsequent printed product would be assigned to the first clamp 14 after the increased pitch spacing. In another alternative, the respectively required conveyor spacing could be realized in a perfect binder with clamps arranged at a pitch spacing T' in that a corresponding number of clamps 14 are not occupied with book blocks.

The invention claimed is:

1. A perfect binder machine for manufacturing printed products from book blocks, comprising:

a book block conveyor (10) with an endless loop (11) that continuously revolves around deflection pulleys (12, 13) at a conveying speed and defines straight conveying sections between the pulleys, and a plurality of clamps (14) of length (L) that are respectively arranged on the endless loop at the same pitch spacing (T) from one another for clamping the book blocks (3, 3.1 . . . 3.8); and at least one processing station that is arranged along a straight conveying section and is adjustable by a motor drive, wherein said processing station is selected from the group including a book block infeed station (25), a spine processing station (18), a glue application station (19), a cover feeder (20), a pressing station (21, 22) and a delivery station (30);

a cycle time ($t_0$) of the processing station is defined by the conveyance of a clamp (14) by at least one pitch spacing (T) through the processing station (25, 18, 19, 20, 21, 22, 30); and the cycle time ($t_0$) of the processing station is divided into an adjusting time segment ($t_{V1}$, $t_{V2}$) for resetting the processing station (25, 18, 19, 20, 21, 22, 30) in accordance with changing printed product characteristics of an upstream book block and a processing time segment ($t_{B1}$, $t_{B2}$) for processing said upstream book block (3, 3.1 . . . 3.8, 4, 4.1 . . . 4.4); wherein at a given moment during operation of the machine a book block is processed while held by a processing clamp; and the cycle time (to) selectively extends over at least two assigned clamps (14) conveyed through said processing station, whereby at least one assigned clamp is situated upstream of the processing clamp that holds the book block, and said at least one assigned clamp does not contain a book block.

2. The machine according to claim 1, wherein the pitch spacing (T) of the clamps (14) is at least twice as long as the length (L) of the clamps.

3. The machine according to claim 2, wherein the pitch spacing (T) of the clamps (14) corresponds to three times the minimum pitch spacing (T') between successive clamps of length (L) that can be accommodated by the book block conveyor (10).

4. The machine according to claim 1, wherein one of the stations is a book block infeed station (25) where successive book blocks are fed to respective book block clamps (14) conveyed at a constant speed and a timing device (27) releases successive book blocks having various formats from a book block queue (3, 3.3 . . . 3.8) to be fed to the corresponding clamp (14) of the respectively selected cycle time.

5. The machine according to one of claim 1, wherein a ratio between the adjusting time segment ($t_{V1}$, $t_{V2}$) and the processing time segment ($t_{B1}$, $t_{B2}$) is variable.

6. The machine according to claim 5, wherein the at least one processing station (25, 18, 19, 20, 21, 22, 30) includes at least one working appliance (61, 66) driven with a motion profile (53.1, 53.2) that is variable within the cycle time ($t_0$) by a drive assembly (62, 63.1, 63.2, 64, 65, 72) actuated with at least one individual drive (72).

7. The machine according to claim 1, wherein the at least one processing station (25, 18, 19, 20, 21, 22, 30) is resettable to a range of printed product formats and no change in the conveying speed of the book block conveyor (10).

8. The machine according to claim 1, including at least one measuring device (41, 43) situated upstream of the at least one processing station (25, 18, 19, 20, 21, 22, 30) for measuring at least one characteristic of a book block (3, 3.1 . . . 3.8) that is subsequently transported to the at least one processing station.

9. The machine according to claim 1, including a control device (40) connected to a drive system (12, 42) of the book block conveying device (10) for successively resetting the processing stations (25, 18, 19, 20, 21, 22, 30) to a different printed product while production continues.

10. The machine according to claim 9, including a device (41) in the book block infeed station (25) for identifying individual book blocks as successively fed from a book block infeed queue (3, 3.3 . . . 3.8) and delivering a corresponding book block identification signal to the control device (40).

11. The machine according to claim 9, wherein the book block infeed station (25) is divided into several successive individual conveying segments (28.1, 28.2, 28.3) for feeding the book blocks (3, 3.1 . . . 3.8) to the clamps (14), and the individual conveying segments are separately adjustable in accordance with the block thickness of the respective book block that subsequently arrives at the respective conveying segment.

12. The machine according to claim 1, wherein one of the stations is a book block infeed station (25) where successive book blocks are fed to respective book block clamps (14) conveyed at constant speed and a timing device (27) releases successive book blocks having various formats from a book block queue (3, 3.3 . . . 3.8) to be fed to and received by respective first and second successive processing clamps;

the cycle time ($t_0$) extends over the conveyance of a plurality of clamps (14) by a combined plurality of pitch spacings (T); and at least one clamp between the first and second processing clamps is not fed and does not receive a book block.

13. A perfect binder machine for manufacturing printed products from book blocks, comprising:

a book block conveyor (10) with an endless loop (11) that continuously revolves around deflection pulleys (12, 13) at a constant conveying speed and defines straight conveying sections between the pulleys, and a plurality of clamps (14) of length (L) that are respectively arranged on the endless loop at the same pitch spacing (T) from one another for clamping the book blocks (3, 3.1 . . . 3.8); and a plurality of processing stations that are arranged along a straight conveying section and are adjustable by a motor drive, wherein said processing stations are selected from the group including a book block infeed station (25), a spine processing station (18), a glue application station (19), a cover feeder (20), a pressing station (21, 22) and a delivery station (30);

a cycle time ($t_0$) of each said processing station is defined by the time interval from the entry into the processing station of one clamp with occupied book block until the entry of a subsequent clamp with occupied next upstream book block into the same processing station; and the cycle time ($t_0$) of each said processing station is divided into an adjusting time segment ($t_{V1}$, $t_{V2}$) for resetting the processing station after said one clamp with occupied book block exits said processing station, in accordance with changing printed product characteristics of said upstream book block, and a processing time segment ($t_{B1}$, $t_{B2}$) for processing said upstream book block in the processing station; wherein at a given moment during operation of the machine a book block is processed while held by a processing clamp; and the cycle time (to) selectively extends over at least two assigned clamps (14) conveyed through said processing station, whereby at least one assigned clamp is situated upstream of the processing clamp that holds the book block, and said at least one assigned clamp does not contain a book block.

14. The machine according to claim 13, including at least one sensor (41, 43) situated at the machine for identifying at least one characteristic of a said upstream book block (3, 3.1 . . . 3.8) and delivering a control signal for dividing the cycle time of each said processing station before the upstream book block enters said processing station.

* * * * *